US005303976A

United States Patent [19]

Nobile et al.

[11] Patent Number: 5,303,976

[45] Date of Patent: Apr. 19, 1994

[54] SEATING UNIT WITH CONVERTIBLE STORAGE TABLE

[75] Inventors: Charles B. Nobile, Belden; Robert E. Cook, New Albany, both of Miss.

[73] Assignee: Mohasco Upholstered Furniture Corporation, Fairfax, Va.

[21] Appl. No.: 933,021

[22] Filed: Aug. 20, 1992

[51] Int. Cl.[5] ..... A47B 83/02

[52] U.S. Cl. ..... 297/146; 297/191; 297/232

[58] Field of Search ..... 297/146, 191, 232, 238, 297/194, 113; 108/26; 312/235.2, 219.2

[56] References Cited

U.S. PATENT DOCUMENTS

| | | | |
|---|---|---|---|
| 2,187,320 | 6/1940 | Hoffstetter | 312/319.2 |
| 2,240,748 | 5/1941 | Bak | 297/146 |
| 2,579,606 | 12/1951 | Oom | 312/235.2 |
| 2,824,599 | 2/1958 | Quinlan | 297/146 |
| 3,304,143 | 2/1967 | Connell | 297/194 |
| 3,951,448 | 4/1976 | Hawie | 297/191 |
| 4,848,839 | 7/1989 | Galardo | 297/194 |
| 5,064,244 | 11/1991 | Sproule | 297/194 |
| 5,104,182 | 4/1992 | Rasnick | 297/194 |

*Primary Examiner*—Flemming Saether

*Attorney, Agent, or Firm*—Robert A. Elwell; Harold D. Jastram; Amy J. Hoffman

[57] ABSTRACT

A multi-functional furniture component has a frame, with a seat portion and a backrest portion, first motion means connected to the frame and connected to a conversion member. The conversion member has a first upholstered side and a second substantially planar side. Actuation of the first motion means enable arcuate movement of the conversion member between a first orientation to service a backrest and a second orientation in which the planar side is generally horizontal. The conversion member may also include a container member with a top panel, a bottom panel spaced apart from the top panel, and at least one side panel interconnecting the top and bottom panels and defining an interior storage region. Preferably, access to the interior storage region is provided by arcuate motion of the top of the container. A horizontally oriented upholstery roll is connected to the upper terminus of the backrest by a live hinge and in a first orientation, partially covers a pocket which may receive the conversion member and in the second orientation, expose the pocket.

17 Claims, 4 Drawing Sheets

SEATING UNIT WITH CONVERTIBLE STORAGE TABLE

BACKGROUND OF THE INVENTION

The present invention relates to a furniture component and, in particular, relates to a reversibly convertible furniture component having a variety of configurations which in turn provide for multiple uses.

Furniture components which provide comfortable seating have been known since ancient times. In modern times a desire for economical space utilization has been partially satisfied by dual-purpose seating components, such as sofas which convert to beds, chairs which recline or incline, and storage units under seating surfaces.

Another trend in modern furniture is the provision of modular furniture. Modular furniture units afford consumers economical semi-custom furniture adapted to a particular individual floor plan. For example, modular sofas are formed from combinations of linear or corner subsections each typically providing a single seating unit. Selecting and combining appropriate subsections can yield a sofa which is semi-custom adapted to a particular room and capable of seating a number of people.

It would be particularly desirable to provide new furniture components, suitable for use in modular furniture, which function in a first orientation as a seating unit and in a second orientation provide additional space-saving functions.

SUMMARY OF THE INVENTION

The present invention includes a multi-functional furniture component including frame, first motion means connected to the frame and a conversion member connected to the first motion means. The frame of the present invention has a seating portion with a generally upwardly directed occupant support surface and a backrest portion substantially upstanding from adjacent an edge of the seating portion. The conversion member has two sides, a first, upholstered side and a second, substantially planar side.

Actuation of the first motion means enables a partially arcuate movement of the conversion member, about a pivot axis, between a first orientation and a second orientation. In the first orientation, the conversion member is characterized by a substantially upstanding first side of the conversion member situated adjacent the backrest portion of the frame and in position to serve as an upholstered backrest for an occupant seated on the occupant support surface. The second orientation of the conversion member is characterized by a generally horizontal and upwardly facing second side of the conversion member in a position at least partially overlying the occupant support surface.

In a preferred embodiment, the conversion member includes a container member having a top panel, a bottom panel spaced apart from the top panel and at least one side panel interconnecting the top and bottom panels. Together the top, bottom and side panels define an interior storage region. Preferably, the container member includes a second motion means for moving one of the panels of the container relative to another panel of the container in order to provide access to the interior storage region. Preferably, the second motion means includes a pivot axis parallel to the pivot axis of the conversion member. Preferably, a live-hinged upholstery roll is connected to the upper terminus of the backrest by a live hinge. Most preferably, such an upholstery roll in a first orientation covers a pocket which is receptive of the conversion member in its first orientation. In a second orientation of the upholstered roll, the pocket is exposed.

In a most preferred embodiment, the second motion means further includes control means for regulation of movement between the panels of the container. Especially preferred is an embodiment in which the control means includes a damper or counter balance means which controls the motion of the top panel of the storage container. An advantage of the control means is the prevention of a rapid and precipitous drop of the top panel. This in turn prevents the undesirable result of causing injury to a person whose limb is accessing the interior storage region of the container member.

The second, substantially planar side of the conversion member may be used as a writing table or may be used to hold a beverage container. These uses are particularly advantageous for a user seated upon an adjoining seat module, when the present invention is a subsection of a modular sofa. It should also be recognized that the storage container is particularly useful to one seated upon an adjoining seat module. Further, the storage unit is relatively undetectable when folded out of the way and covered by the upholstery roll in its first orientation because the present invention then serves as a seating unit in a module sofa.

DETAILED DESCRIPTION OF THE PREFERRED EMBODIMENTS

Figure 1:
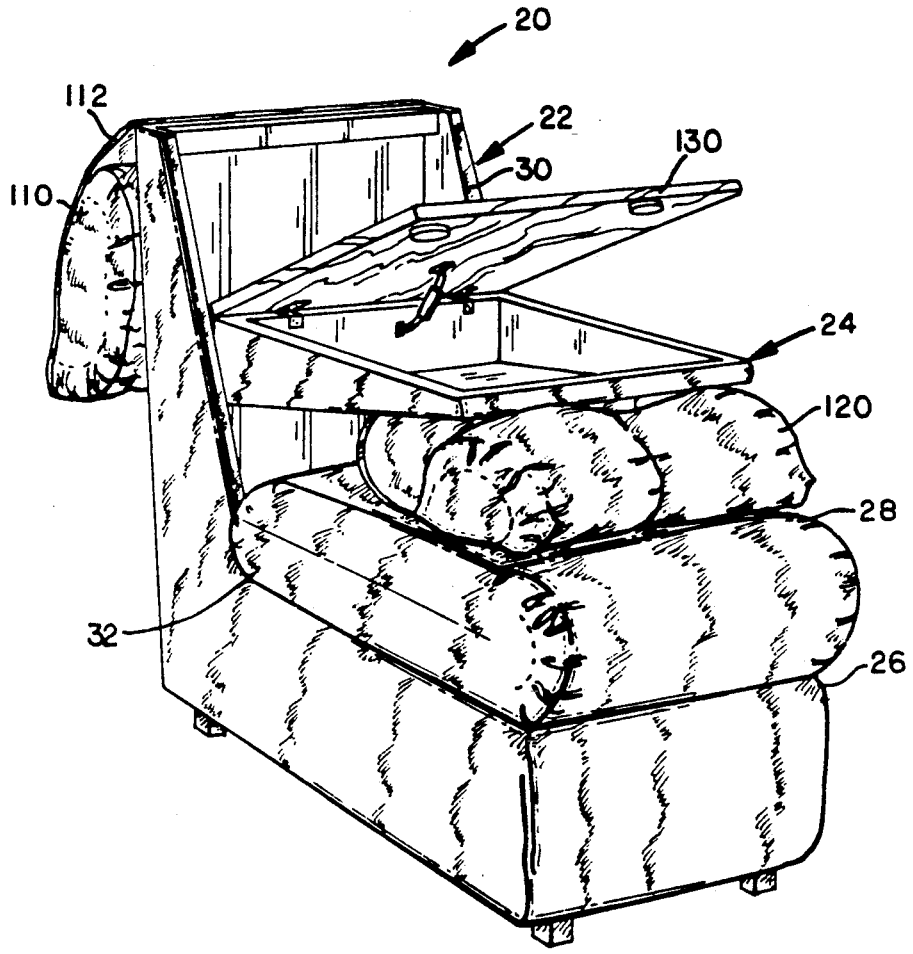
FIG. 1 is a perspective view of a preferred embodiment of the present invention with the conversion member in the second orientation and the top panel positioned to provide access to the interior storage region.

In the first embodiment, the present invention 20, shown in FIG. 1, includes a frame, 22 and a conversion member 24 connected to the frame 22 through a first motion means.

The frame 22 includes a seat portion 26 with a generally upward directed upholstered occupant seat support surface 28 and a backrest portion 30 which is substantially upstanding from adjacent a rear edge or juncture 32 of the seat portion 26 with the backrest portion 30.

Figure 4:
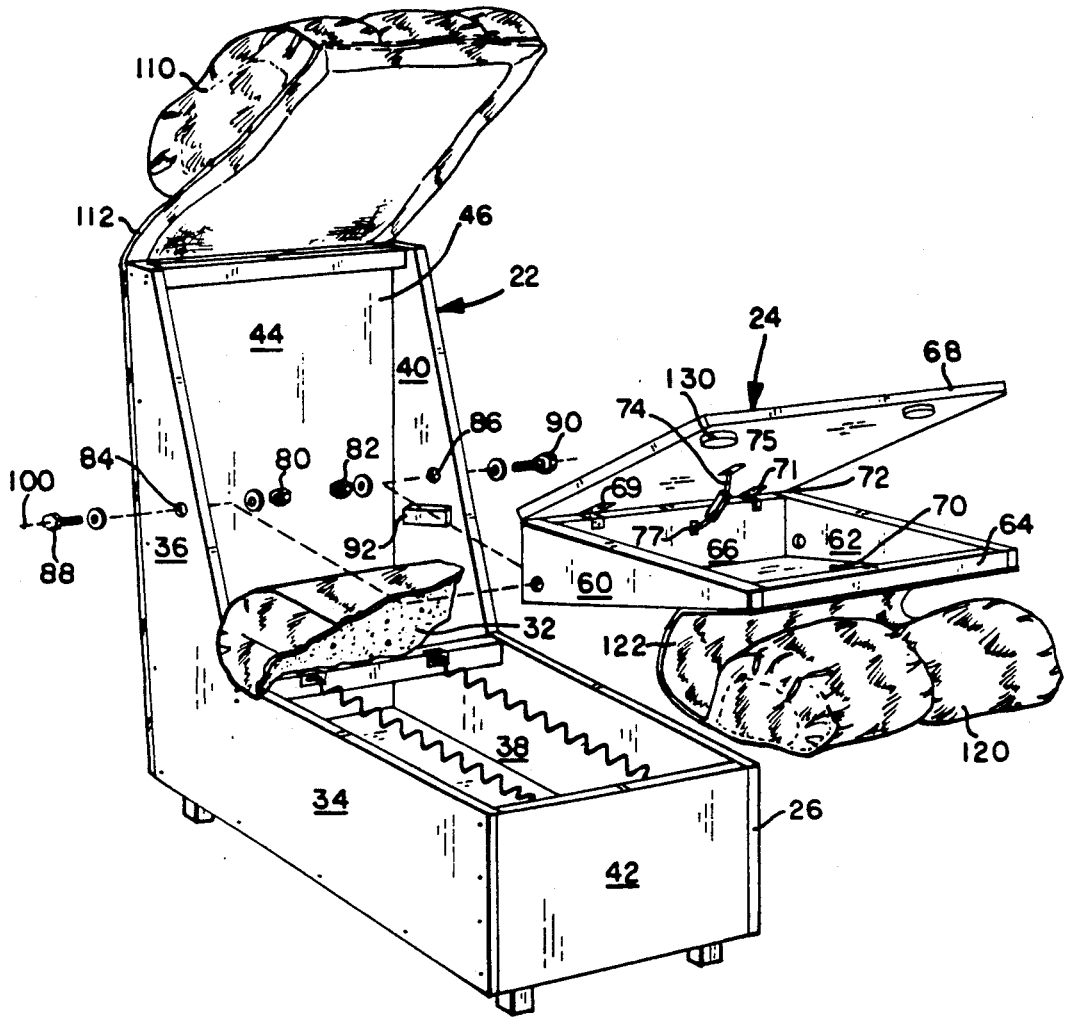
FIG. 4 is an exploded perspective view of the preferred embodiments with portions of upholstery removed.

The frame 22 may be constructed from plywood by providing (as shown in FIG. 4 in an exploded perspective view) a right side panel 34 with an integral upstanding right wing 36, a left panel 38 with an upstanding left wing 40 joined together by a front panel 42 and a rear panel 44. Rear panel 44 connects the rear edge of the right and left side panels 34 and 38 as well as extending upward to connect the right wing 36 with the left wing 40. Appropriate joining methods for joining such frame panels are well known in the furniture industry and well within the skill of the furniture art. Resilient webbing or plywood serve to support the occupant support cushion 28 (shown in FIG. 1) on the seat portion 26. Again, such structure and methods for supporting a seating cushion 28 are well known in the furniture art. Together, the right wing 36, upper portion of the rear panel 44 and left wing 40 define a pocket 46.

The conversion member 24 includes a right side panel 60 and left side panel 62, a front panel 64, a rear panel 66, a top panel 68 and a bottom panel 70. Preferably, the right side panel 60 and left side panel 62 are symmetrical and trapezoidal or alternatively nearly triangular in shape such that the front panel 64 is shorter than the rear panel 66. The top 68 and bottom 70 panels are preferably rectangular in shape. The top 68 and bottom 70 panels along with the various side panels form a container member with an interior storage region. Preferably, the top panel 68 is joined to the rear panel 66 by a hinge 69, 71 or pivot which enables arcuate motion of the top panel relative to the conversion member 24 about a pivot axis 72. Alternatively, a continuous or piano-type hinge may be employed to connect top panel 68 to rear panel 66.

Additionally, the motion of the top 68 relative to the rear panel 66 is controlled by a mechanism 74 which may alternatively be a damping mechanism or a counterbalance spring. The control mechanism 74 prevents inadvertent dropping of the top 68 which might result in an unfortunate pinching or crushing of hands which might be, for example, atop the front panel 64. Appropriate damping mechanisms are available from numerous hardware suppliers. A wide variety of damping rates may be used. Typically appropriate damping units would be lighter duty units than those used in the automotive industry to support hoods and trunk lids. Control mechanism 74 is most preferable connected to the underside of top panel 68 by a bracket 75 and the inside face of rear panel 66 by a bracket 77.

Additionally, the conversion member 24 includes a pair of nuts 80 and 82 in the lower rear corner of each of the right side panel 60 and left side panel 62. A pair of apertures 84 and 86 adjacent the leading edge of the right wing 36 and left wing 40 near the juncture 32 with the right side panel 34 and left side panel 38 allow passage of a pair of bolts 88 and 90 are passed through apertures 84 and 86 and tightened into nuts 80 and 82, respectively, to form a pivot axis 100 for the conversion member 24 to move relative the frame 22. The nuts 80 and 82 may be T-nuts which have prongs allowing attachment into apertures in the conversion member 24. Further, the bolts 88 and 90 may be self locking bolts by employing threads of increasing thickness. These details of the pivot forming the first motion means between the frame and the conversion member facilitate economical assembly of the present invention. A stop 92 on the inside surface of wing 40 limits rotation of the conversion member 24 about pivot axis 100 to establish a second orientation of the conversion member 24 such that the top panel 68, when closed against the front panel 64 is generally horizontal. Specifically, the stop member 92 intercepts the motion of side panel 62.

The conversion member 24 may occupy in a first orientation, the rear pocket 44 such that it is substantially upstanding from adjacent the upper rear edge 32 of the seat portion 26 (i.e. adjacent the juncture between the seat portion and the backrest portion of the frame). In this orientation, the bottom panel 70 of the conversion members 24 is generally in a vertical orientation. The exposed first side of the bottom panel 70 is preferably upholstered and may serve as a backrest for an occupant seated on the occupant support surface cushion 28.

Figure 3:
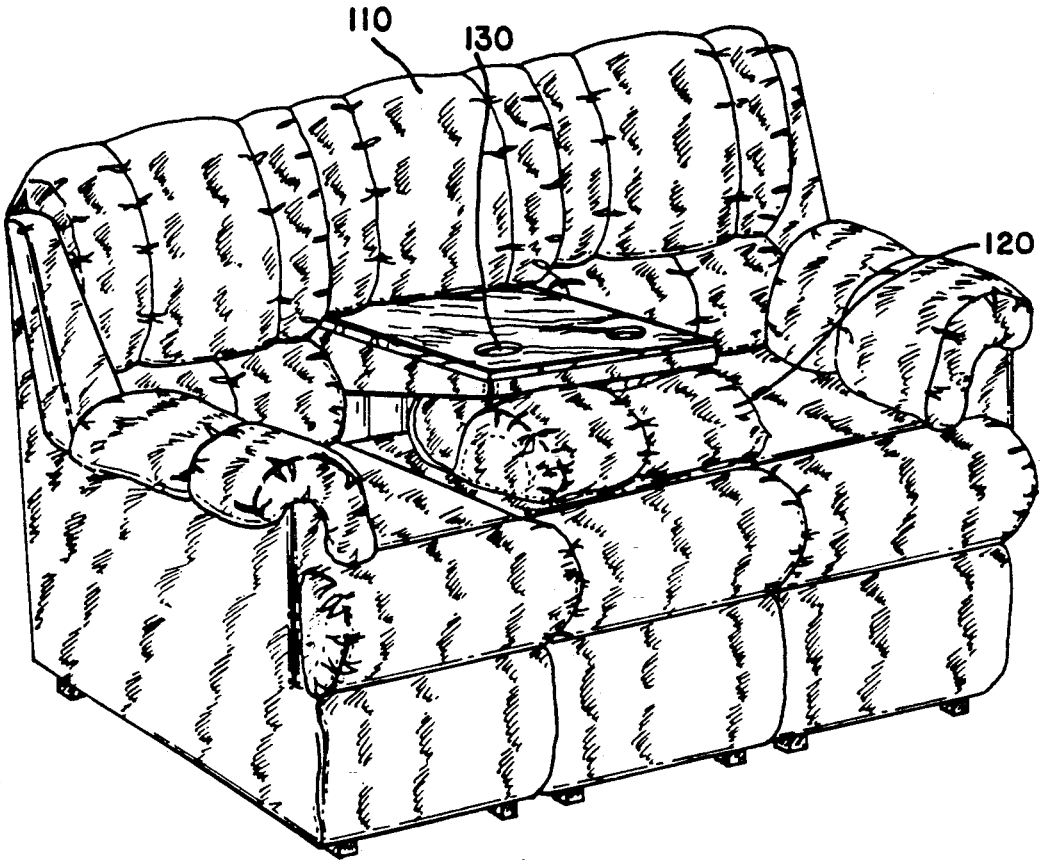
FIG. 3 is a perspective view of the preferred embodiment interposed between two subsections of seating to form a modular furniture assembly.

In the second orientation (as shown in FIGS. 1 and 3, the conversion member 24 has a generally horizontal and upward facing second side, i.e. the outside of the top panel 68, in a position at least partially overlying the occupant support surface cushion 28.

Figure 2:
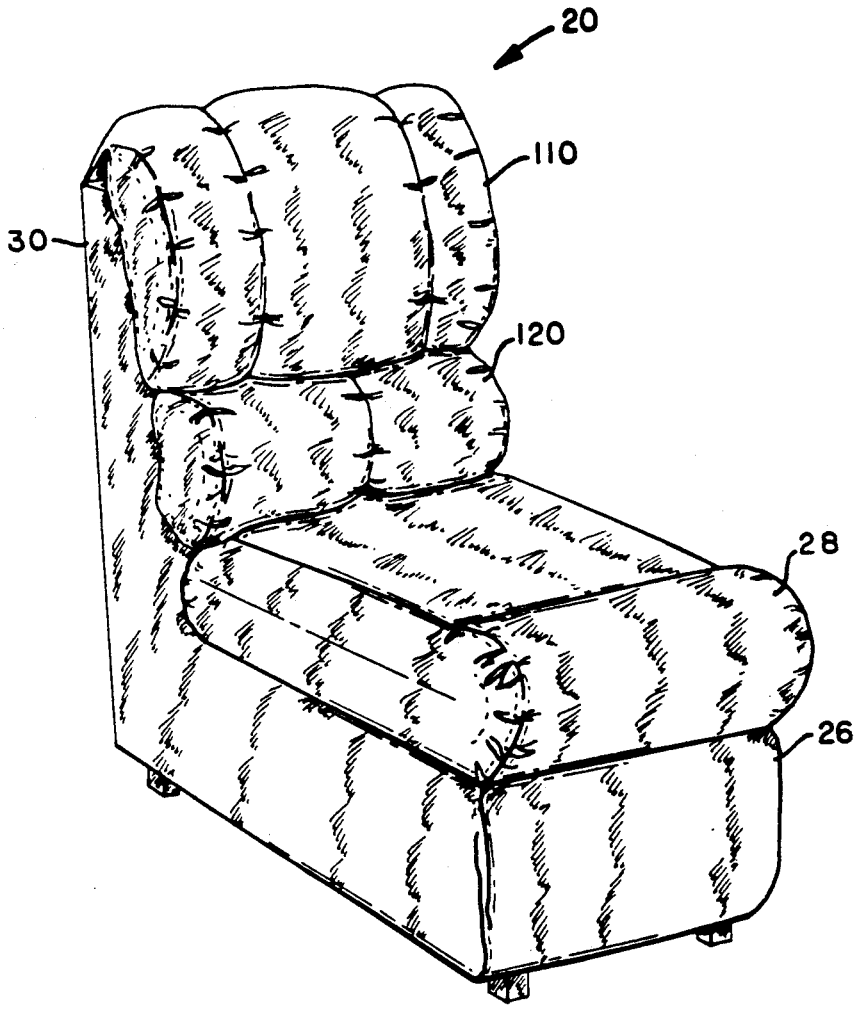
FIG. 2 is a perspective view of the preferred embodiment with the conversion member in the first orientation.

A rolled upholstery cushion 110 is joined by a live hinge portion of fabric 112 to the upper terminus of the backrest portion 30. The rolled cushion 110 may be moved about the live hinge 112 such that it either exposes (FIG. 1) or partially covers (FIG. 2) the rear pocket 44. The outside surface of the bottom 70 of the conversion unit 24 may also be upholstered by a horizontally oriented rolled cushion of upholstery 120 joined to the surface by live hinge 122. When the conversion member 24 is in the first orientation (FIG. 2), i.e. received with the pocket 44, rolled cushion 110 may be moved to cover the front panel 64 and a portion of the bottom 70 which is most distal from the pivot access 100. Similarly, the rolled cushion 120 pivots on live hinge 122 so as to provide a comfortable backrest for an occupant seated upon the occupant support cushion 28. In this first orientation (FIG. 2), the present invention 20 appears as an ordinary seat, and blends into a group of modular seats employing a similar upholstery approach on their seating cushions and backrest portions (FIG. 3). Such upholstery appearances may be also employed, for example, on motion furniture such as recliners or incliners or alternatively, on hide-a-bed units.

In the second orientation, the conversion unit 24 provides a tabletop-like surface to a user seated adjacent the invention 20. The top surface 68 may include beverage container receptacles 130. Additionally, when beverage container receptacles 130 are not in use, the top panel 68 may be raised by rotation about the pivot axis 72 to provide access to more storage for the storage container defined within. The control mechanism 74 serves to protect from pinched fingers or hands when the top has been raised by prevent precipitous fall of the container top panel 68.

Although the present invention has been described with reference to the preferred embodiments, workers skilled in the art will recognize that changes may be made in form and detail without departing from the spirit and scope of the invention.

What is claimed is:

1. A multi-functional furniture component, comprising:

a frame, the frame having a seat portion with a generally upwardly directed, upholstered occupant support surface and a backrest portion substantially upstanding from adjacent an edge of the seat portion;

first motion means connected to the frame;

a conversion member connected to the first motion means and having a first, upholstered side and a second, substantially planar having a tabletop-like surface side;

and wherein actuation of the first motion means enables at least a partially arcuate movement of the conversion member between a first orientation characterized by a substantially upstanding first side of the conversion member adjacent the backrest portion of the frame and in a position to serve as a backrest for an occupant seated on the occupant support surface and a second orientation characterized by a generally horizontal and upward facing second side of the conversion member in a position at least partially overlying the occupant support surface and wherein the backrest portion of the frame includes a pocket receptive of the conversion member in the first orientation and further includes an upholstery roll, generally horizontally oriented and connected to the backrest adjacent the upper terminus of the backrest by a live hinge and the upholstery roll connected to the backrest portion partially covers the pocket in a first orientation and exposes the pocket in an second orientation.

2. The multi-functional furniture component of claim 1 and wherein the first motion means includes at least one pivot, the at least one pivot defining a pivot axis for arcuate motion between the conversion member and the frame.

3. The multi-functional furniture component of claim 2 and wherein the first pivot axis is adjacent the juncture of the upholstered occupant support surface of the seat portion and the backrest portion.

4. The multi-functional furniture component of claim 1 and wherein the first motion means includes a hinge, the hinge defining a pivot axis for arcuate motion between the conversion member and the frame.

5. The multi-functional furniture component of claim 1 and wherein the conversion member includes:

a container member having a top panel, a bottom panel spaced apart from the top panel and at least one side panel interconnecting the top panel and bottom panel, the top, bottom and side panels defining an interior storage region.

6. The multi-functional furniture component of claim 4 and wherein the container member further includes:

second motion means for moving one of the panels of the container relative to another panel of the container to provide access to the interior storage region.

7. The multi-functional furniture component of claim 6 and wherein the second motion means enables an arcuate motion of the top of the container about a second pivot axis generally parallel to the first pivot axis.

8. The multi-functional furniture component of claim 7 and wherein the pivot includes a bolt.

9. The multi-functional furniture component of claim 6 and wherein the second motion means further includes:

control means for regulation of movement between the panels of the container.

10. The multi-functional furniture component of claim 9 and wherein the control means includes a shock absorber.

11. The multi-functional furniture component of claim 10 and wherein the control means includes counterbalance spring.

12. The multi-functional furniture component of claim 1 and wherein the upholstered side of the conversion member includes at least one horizontally oriented upholstery roll.

13. The multi-functional furniture component of claim 12 and wherein the upholstery roll connected to the upholstered side of the conversion unit by a live hinge.

14. The multi-functional furniture component of claim 1 and wherein the first motion means further includes a horizontal limit means.

15. A multi-functional furniture component, comprising:

a frame, the frame having a seat portion with a generally upwardly directed, upholstered occupant support surface and a backrest portion substantially upstanding from adjacent an edge of the seat portion;

first motion means connected to the frame;

a conversion member connected to the first motion means and having a first, upholstered side and a second, substantially planar side;

and wherein actuation of the first motion means enables at least a partially arcuate movement of the conversion member between a first orientation characterized by a substantially upstanding first side of the conversion member adjacent the backrest portion of the frame and in a position to serve as a backrest for an occupant seated on the occupant support surface and a second orientation characterized by a generally horizontal and upward facing second side of the conversion member in a position at least partially overlying the occupant support surface, and wherein the backrest portion of the frame includes a pocket receptive of the conversion member in the first orientation and further includes an upholstery roll, generally horizontally oriented and connected to the backrest adjacent the upper terminus of the backrest by a live hinge and the upholstery roll connected to the backrest portion partially covers the pocket in a first orientation and exposes the pocket in an second orientation.

16. A sofa comprising:

a plurality of seating unit components in a linear array;

and wherein at least one of the seating unit components of the array is a multi-functional furniture component, including:

a frame, the frame having a seat portion with a generally upwardly directed, upholstered occupant support surface and a backrest portion substantially upstanding from adjacent an edge of the seat portion;

first motion means connected to the frame;

a conversion member connected to the first motion means and having a first, upholstered side and a second, substantially planar side;

and wherein actuation of the first motion means enables at least a partially arcuate movement of the conversion member between a first orientation characterized by a substantially upstanding first side of the conversion member adjacent the backrest portion of the frame and in a position to serve as a backrest for an occupant seated on the occupant support surface and a second orientation characterized by a generally horizontal and upward facing second side of the conversion member in a position at least partially overlying the occupant support surface and wherein the backrest portion of the frame includes a pocket receptive of the conversion member in the first orientation and further includes an upholstery roll, generally horizontally oriented and connected to the backrest adjacent the upper terminus of the backrest by a live hinge and the upholstery roll connected to the backrest portion partially covers the pocket in a first orientation and exposes the pocket in an second orientation.

17. The sofa of claim 16 and wherein at least one of the seating units of the array adjacent the multi-functional furniture component is a motion seating unit.

* * * * *